US005684516A

United States Patent [19]

Cseledy et al.

[11] Patent Number: 5,684,516

[45] Date of Patent: Nov. 4, 1997

[54] PRINT STATION IN AN INK JET PRINTER

[75] Inventors: David Michael Cseledy; Monty Lane Francis; Edmund Hulin James, III; Gregory Willis Peterson; Donald Norman Spitz, all of Lexington, Ky.

[73] Assignee: Lexmark International, Inc., Greenwich, Conn.

[21] Appl. No.: 149,434

[22] Filed: Nov. 9, 1993

[51] Int. Cl.[6] ..... B41J 25/308; B41J 2/01

[52] U.S. Cl. ..... 347/8; 347/104

[58] Field of Search ..... 347/8, 90, 104, 347/73, 35; 400/55, 56, 58

[56] References Cited

U.S. PATENT DOCUMENTS

| | | | |
|---|---|---|---|
| 4,050,075 | 9/1977 | Hertz et al. | 347/73 |
| 4,062,020 | 12/1977 | Berglund | 347/73 |
| 4,442,440 | 4/1984 | Elchinger | 347/90 |
| 4,580,148 | 4/1986 | Domoto et al. | 347/63 |
| 4,843,338 | 6/1989 | Rasmussen et al. | 347/8 |
| 5,040,000 | 8/1991 | Yokoi | 347/30 |
| 5,065,169 | 11/1991 | Vincent et al. | 347/8 |
| 5,136,307 | 8/1992 | Uchida et al. | 346/136 |
| 5,291,227 | 3/1994 | Suzuki | 347/35 |
| 5,343,229 | 8/1994 | Ohshima | 347/8 |

*Primary Examiner*—Benjamin R. Fuller
*Assistant Examiner*—Craig A. Hallacher
*Attorney, Agent, or Firm*—John J. McArdle, Jr.

[57] ABSTRACT

A serial drop-on-demand ink jet printer having an ink cartridge mounted for reciprocation on a carrier which traverses paper advancing through the printer. The cartridge includes a nozzle array for the ejection of ink droplets onto the paper, and the carrier includes a tab upstream from the nozzle array, in the direction of paper travel, which touches the top surface of the paper and sets the printhead-to-paper gap. The paper is pushed against the tab and maintains a minimum gap to prevent paper from coming into contact with the nozzle array. The paper is urged against the tab into the proper position relative to the nozzle array by a deflectable guide which acts on the back surface of the paper. In the printing zone of the ink jet printer, there is therefore no support structure for paper beneath the printhead, and advantageously a trough is provided in this area extending the width of the paper path so that if ink is ejected in the absence of paper, the ink is ejected into the trough where it will dry over time without being contacted by subsequent sheets of paper being fed through the printer.

5 Claims, 5 Drawing Sheets

PRINT STATION IN AN INK JET PRINTER

BACKGROUND OF THE INVENTION

In an ink jet printer, a sheet of paper or other transfer medium is advanced past a print station at which droplets of ink are applied to the paper from a nozzle array. After paper has traversed the printing station where the nozzle array is located, it is ejected from the printer and the next sheet of paper is advanced through the print station.

In one form of ink jet printer, a serial drop-on-demand printer, a printhead having a nozzle array of limited width is reciprocated transversely to the direction of paper travel in order to place ink droplets on the paper to effect printing. Typically today, a disposable ink cartridge including the nozzle array is mounted for reciprocation on a carrier which traverses the advancing paper. Usually, the nozzles are pointed downward; and a surface, referred to as a platen, lies below the nozzle army to support the paper. The paper rests on the platen, with the carrier kept a specified distance from the top surface of the platen in order to maintain a gap between the paper and the printhead. Accurately maintaining this gap is essential to controlling the ink drop dot location on the paper, the spot size and misdirected satellite drops.

One problem with this approach to maintaining the gap between the paper and the printhead is that a number of parts size tolerances can additively create too large a variation in the paper-to-printhead gap. In some instances, for example, the printhead carrier and platen are fixed relative to a paper guide; and the accumulation of tolerances between the printhead, the carrier, the guide surface, and the paper all contribute to printhead-to-paper spacing variations.

In another form of print station, a spacer on the printhead or on the carrier rides on the paper and pushes it against the platen. This has the drawback of increased frictional forces both in the reciprocation of the printhead and in the movement of the paper past the print station.

Another phenomenon of prior print stations of this type is that ink can be ejected from the printhead onto the platen or other parts of the printer which will be contacted by subsequent sheets of paper passing through the printer. For example, a print job might call for a printed page on A4 size paper, but an envelope or narrower sheet of paper is actually being fed through the printer. In this case excess ink is ejected beyond one or both lateral edges of the undersized print medium. Other situations can arise where there are holes in paper, paper is fed at an angle, or a paper jam occurs. Conditions such as these result in ink being ejected onto the platen and other parts of the printer. Subsequent sheets of paper will pick up the ink from the platen if the ink is not cleaned prior to further printing operations.

To overcome these shortcomings, the present system employs a type of a "platenless" print station.

In accordance with one aspect of the invention, in a serial drop-on-demand ink jet printer, in order to eliminate some of the more significant tolerances in spacing the paper from the nozzle array on the printhead, a small tab is provided on the carrier upstream from the nozzle array. The bottom surface of the tab touches the top surface of the paper and sets the printhead-to-paper gap. This eliminates the tolerances between the carrier and a guide surface, the thickness of a guide surface, the thickness of the paper or print medium, and the variation in how the paper lines up against the bottom of the guide surface. Instead, the paper is pushed against the tab and maintains a minimum gap and therefore eliminates the possibility of paper coming into contact with the nozzle array and causing a smear.

In order to push the paper against the tab and into proper position relative to the nozzle array, a deflectable flap urges the paper toward the tab, with the paper-contacting flap surface ending upstream from both the tab and the nozzle array. Frictional forces on the reciprocating printhead and those which would interfere with the paper drive are greatly reduced from those generated in the use of a rigid support surface for the paper.

In addition, with the absence of support structure for the paper beneath the printhead in the vicinity of the nozzle array, a trough is provided extending the width of the maximum width of paper to be printed upon beneath the reciprocating path of the printhead. The trough lies below the paper support structure so that if ink is ejected into the trough, it will merely dry over time without being contacted by subsequent sheets of paper being fed through the printer. This trough could also be used to intentionally eject droplets of ink from the nozzle array in the printer for maintaining and cleaning the printhead.

DETAILED DESCRIPTION

Figure 1:
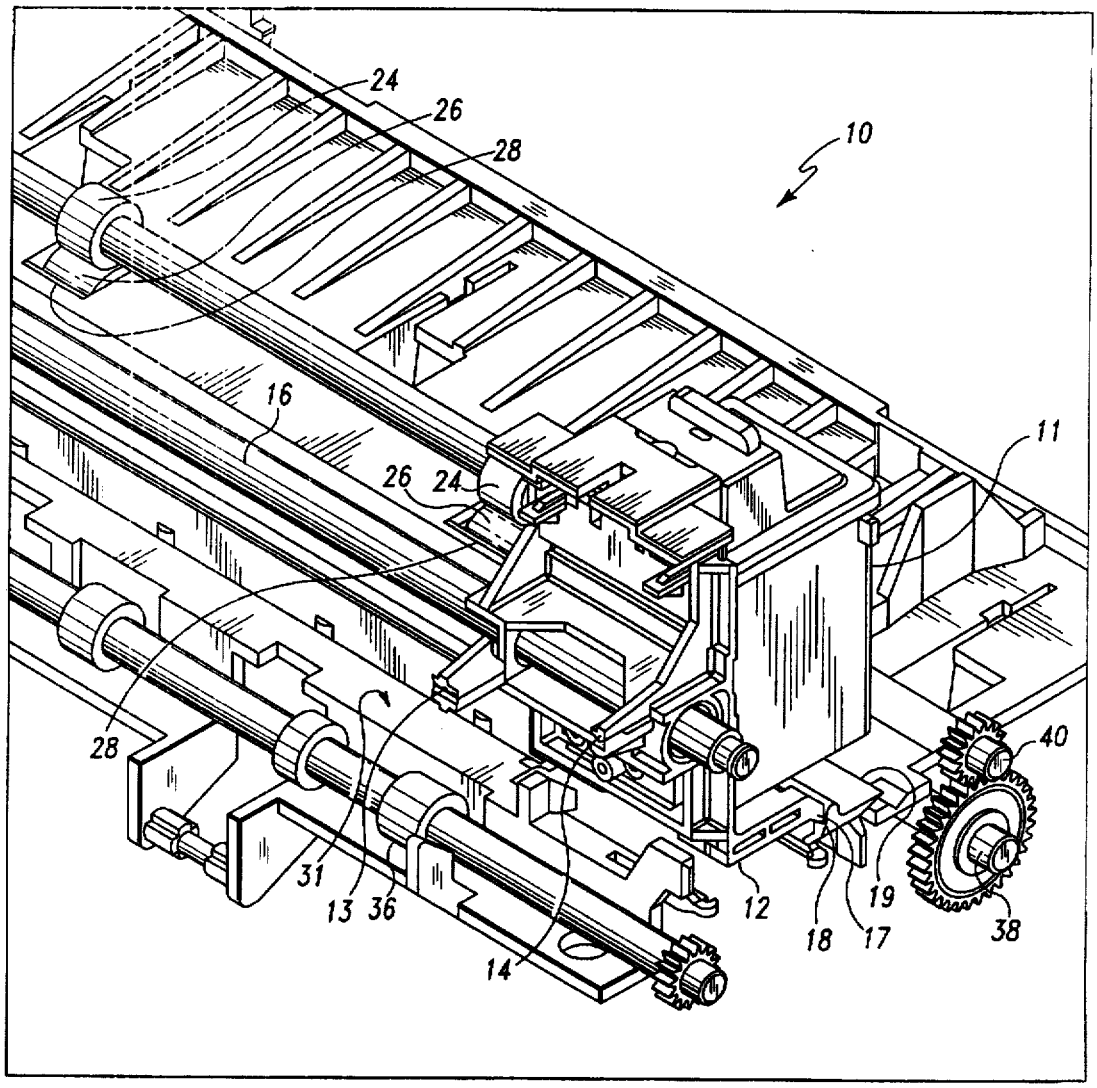
FIG. 1 is a perspective view, with parts removed, of an ink jet printer in accordance with the present invention.

The ink jet printer to be described herein will be described and claimed with reference to printing on a sheet of paper or sheets of paper passing through the printer. It will be understood that this designation of print medium is meant to include other forms of print media such as envelopes, transparencies, card stock and the like. In the figures, FIGS. 1 and 2 each show an ink jet printer with portions removed to facilitate illustration of the present invention.

Figure 2:
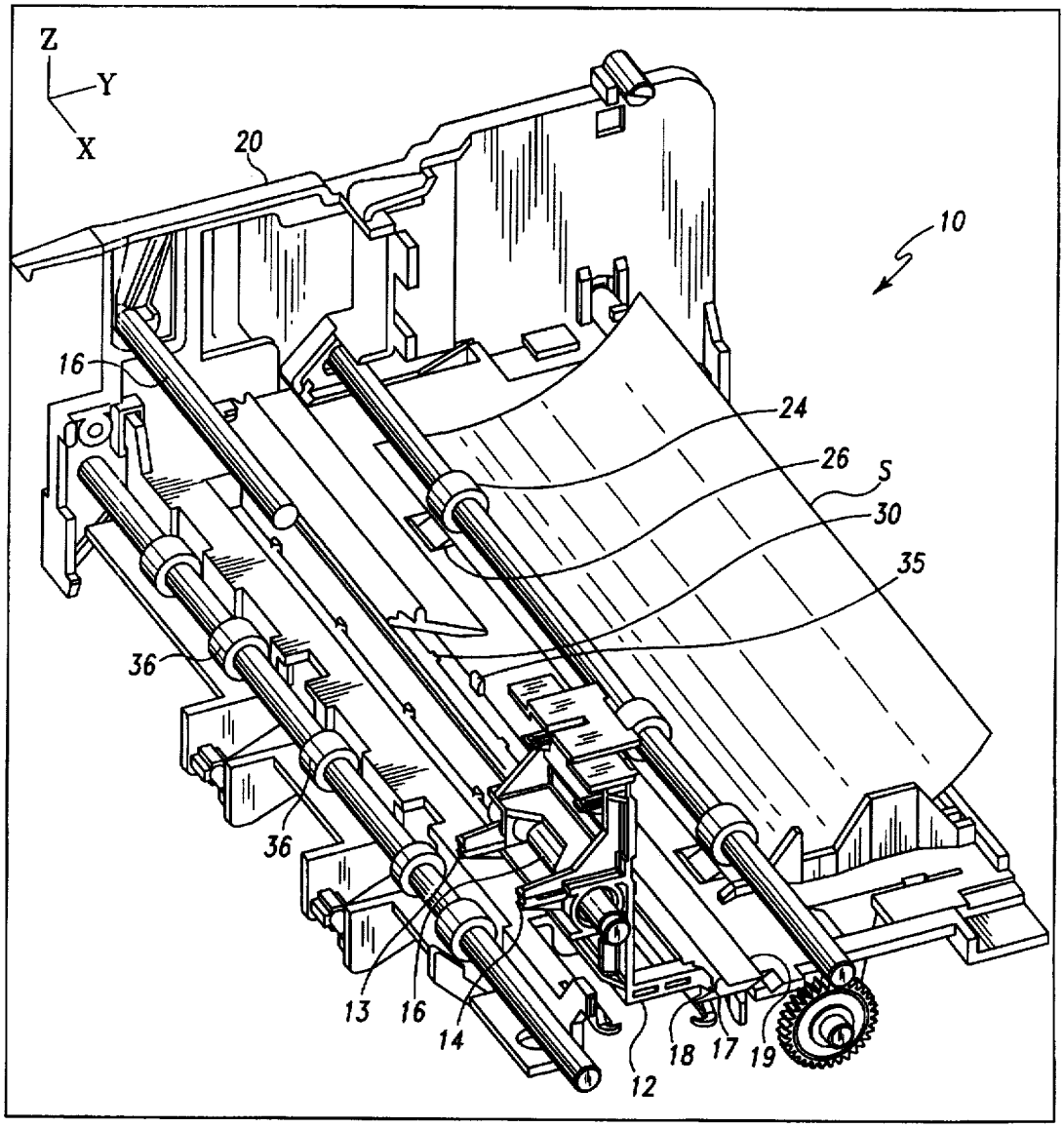
FIG. 2 is a perspective view, with the printhead and other parts removed, of the ink jet printer of FIG. 1, showing a sheet of paper being introduced into the printer, and one side frame of the printer.
Figure 3:
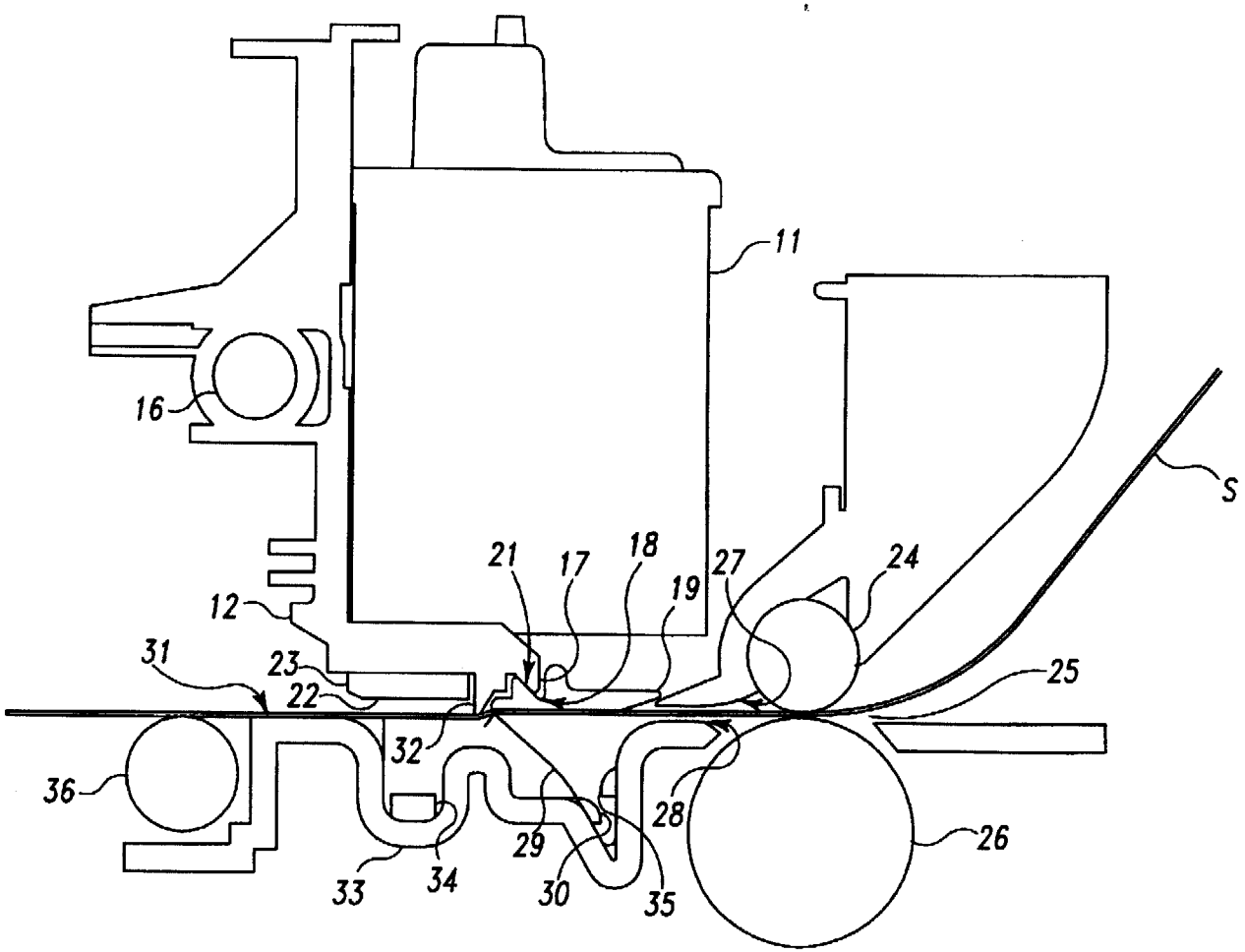
FIG. 3 is a diagrammatic side view of the printer of FIGS. 1 and 2 showing a sheet of paper in the vicinity of the printing zone.

With reference to the figures, an ink jet printer 10 includes a printhead assembly made up of a cartridge 11 and a carrier 12. The cartridge 11 is removably secured in the carrier 12 by a spring-loaded latch (not shown). The carrier 12 is reciprocated by a drive belt (not shown) secured at belt attachment points 13 and 14. The carrier 12 is moved back and forth along a guide rod 16 (shown with a portion removed in FIG. 2), with a pair of feet 17 riding in a groove 18 in a guide rail 19 which is secured to the side frames 20 (one of which is shown in FIG. 2) of the printer. Each foot 17 includes a surface which rides along a sloped surface defining one side of the groove 18 as indicated at 21 (FIG. 3). A nozzle plate 22 on the bottom of a downwardly extending portion 23 of the cartridge 11 contains an array of nozzles (not shown) for ejecting ink droplets in a downward direction. In the illustrated form of the invention, the portion 23 of the cartridge 11 includes a thermal printhead chip which receives ink from the body of the cartridge 11 in nozzle chambers having individual heaters associated therewith.

A sheet of paper S is advanced through the printer from a paper supply (not shown) and fed to the vicinity of the printhead by several pairs of rollers 24, 26. The rollers 26 extend through openings 25 in the mid-frame in order to engage the paper S. The paper then moves below a deflector 27 and above a portion 28 of the mid-frame of the printer. The rollers 24, 26 are mounted on a pair of shafts 38, 40 which, along with the deflector 27 and the mid-frame are supported by the side frames 20 of the printer.

Figure 4:
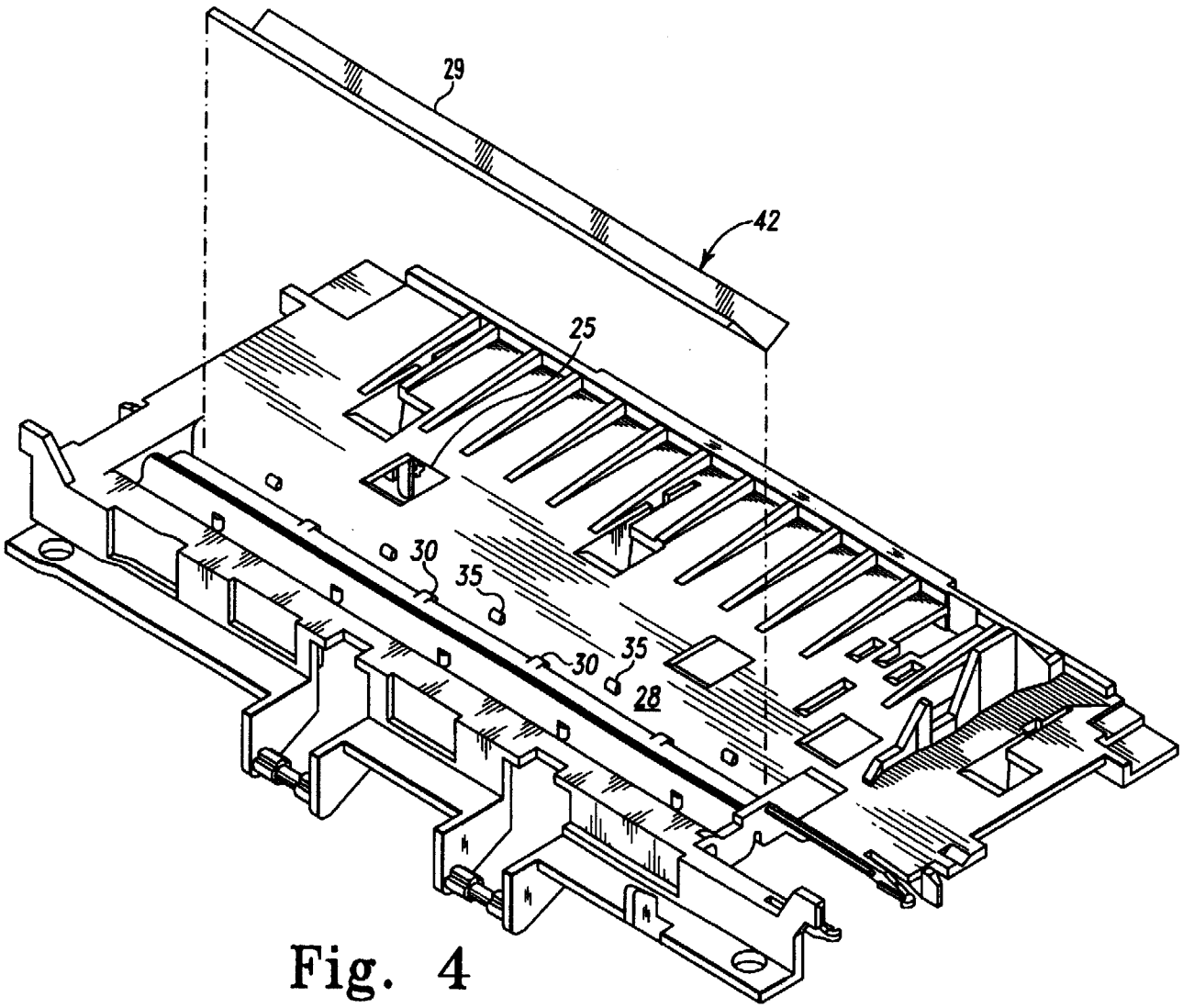
FIG. 4 is a perspective view of the mid-frame of the printer of FIG. 1, with the paper deflector flap shown removed therefrom.

As the paper is advanced by the rollers 24 and 26, the front edge of the paper moves beneath the guide rail 19 and encounters a paper flap 29. The deflector 27, the mid-frame including its portion 28, the guide rail 19 and the paper flap 29 extend at least the width of the paper path along which the sheets of paper S travel. The paper flap 29 is a laminate of polycarbonate and acrylic secured in the mid-frame by projecting fingers 30, 35 molded into the mid-frame. The fingers 30 are received in openings in the flap 29, and the fingers 35 extend over the rear edge 42 (FIG. 4) of the flap 29, holding it in place.

The paper flap urges the sheet of paper S against the underside of the guide rail 19. As the paper moves beyond the flap 29, and before it is contacted by a carrier tab 32, its top surface is slightly closer to the nozzle array 22 than the final printhead-to-paper gap. As the printhead carrier 12 reciprocates across the paper, the tab 32 extending from the bottom of the carrier 12 deflects the paper downwardly and maintains it at a substantially fixed distance from the nozzle array 22 during printing.

Figure 5:
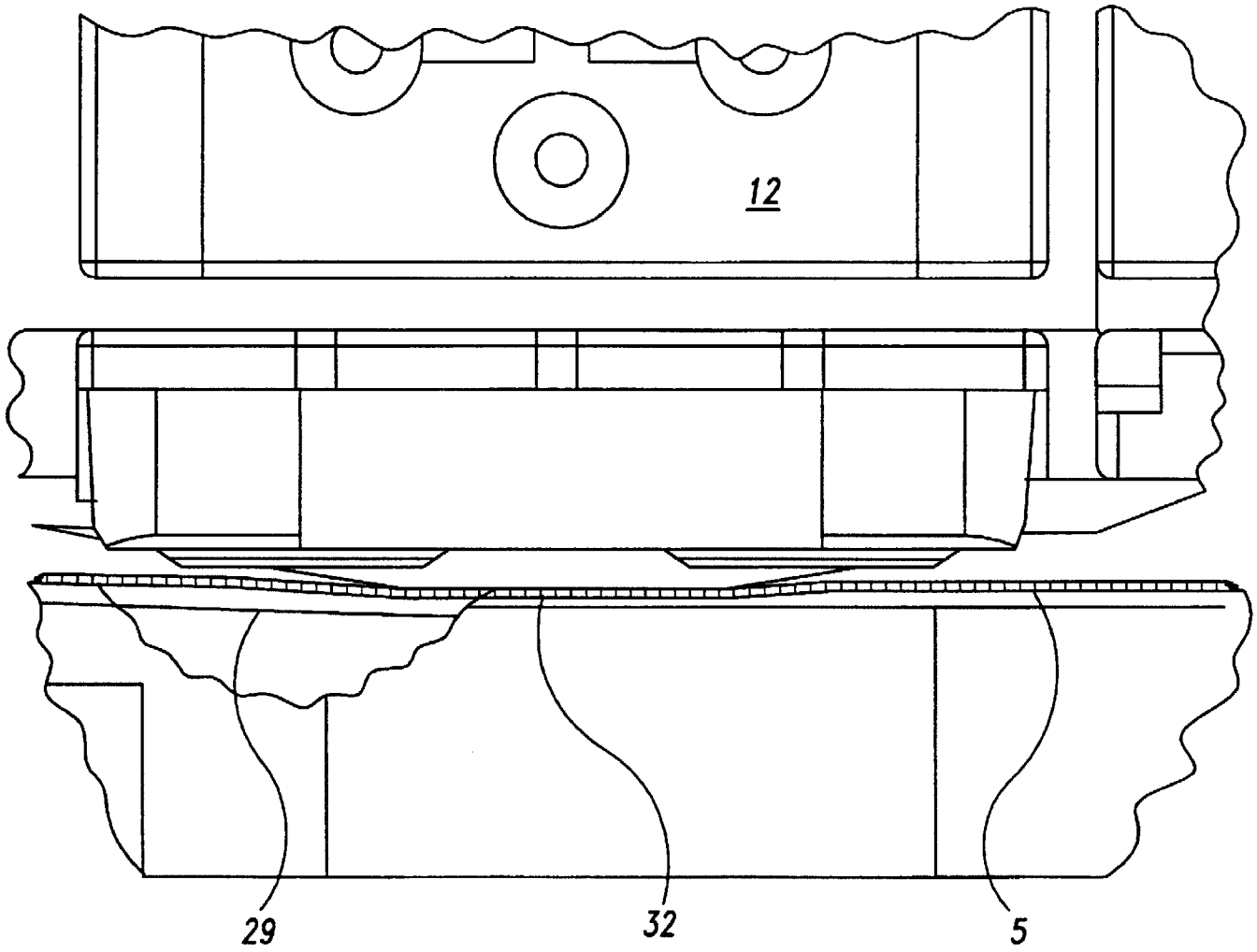
FIG. 5 is a front view of a portion of the printer of FIG. 1, showing the positions of the deflector flap and paper in the vicinity of the printhead.

As best seen in FIG. 5, the paper flap 29 deflects downwardly with the paper as the carrier tab 32 reciprocatingly encounters the paper. Therefore at any point in the traverse of the carrier, the paper S and the paper flap 29 will be deflected downward to set the printhead-to-paper gap in the vicinity of the carrier tab 32. Away from the carrier tab, the paper remains in contact with the underside of the guide rail 19 at a reduced gap, with the paper flap undeflected.

Advantageously, papers of various thicknesses can still be maintained at the desired printhead-to-paper gap. The carrier tab 32 sets the gap to the top surface of the paper, and differing thicknesses of paper are accommodated by flexure of the paper flap 29.

As shown in FIG. 3, there is no platen or paper support structure lying below the nozzle plate 22 of the printhead cartridge 11. In addition, there is formed beneath the path of travel of the nozzle array 22 a trough 33, defined by a portion of the mid-frame, for receiving ink from the printhead when ink is ejected in the absence of paper. A felt gutter pad 34 is provided in the trough 33 to facilitate the drying of ink which is ejected into the trough. The felt pad also guards against wet ink being able to run out of the trough if the printer is tilted while being transported.

Paper moving beyond the surface 31 of the mid-frame, located downstream from the printhead, is engaged by a roller 36 and a star roller (not shown) above the roller 36 to move the paper out of the printer.

We claim:

1. An ink jet printer comprising:

an ink jet printhead assembly disposed on a first side of a paper path, said printhead assembly including a nozzle array from which ink droplets are ejected;

means for advancing a sheet of paper in a first direction along said paper path from a first position upstream of the nozzle array past the nozzle array to a position downstream from the nozzle array, said printhead assembly including a tab upstream from the nozzle array operable to deflect and space a sheet of paper from the nozzle array;

a deflectable member on a second side of the paper path opposite said first side and positioned to urge a sheet of paper advancing toward the nozzle array and into contact with the tab upstream from the nozzle array; and support means for supporting a sheet of paper downstream from the nozzle array, said deflectable member and said support means defining an upstream extent and a downstream extent, respectively, of an area on said second (the other) side of the paper path along which a sheet of paper is unsupported.

2. The ink jet printer of claim 1 in which the ink jet printhead assembly may be reciprocated in a second direction transverse to said first direction, the deflectable guide extending generally across the paper path in said second direction, and wherein said tab reciprocates with the printhead assembly.

3. The ink jet printer of claim 2 in which the ink jet printhead assembly comprises an ink cartridge which includes the nozzle array and a cartridge carrier supporting the ink cartridge, wherein the tab is a portion of the cartridge carrier.

4. An ink jet printer comprising:

an ink jet printhead assembly including a nozzle array facing generally downwardly and operable to eject ink droplets from the nozzle array;

means for advancing a sheet of paper in a first direction along a paper path from a position upstream of the nozzle array past the nozzle array to a position downstream from the nozzle array, the printhead assembly including a downwardly extending tab upstream from the nozzle array;

means for reciprocating the ink jet printhead assembly in a second direction transverse to said first direction;

a fixed guide surface above the paper path, extending generally across the paper path in said second direction, said fixed guide surface being upstream of the tab;

a deflectable guide below the paper path and the fixed guide surface, said deflectable guide extending generally across the paper path in said second direction upstream of the nozzle array and positioned to urge a sheet of paper against the fixed guide surface; and support means for supporting a sheet of paper downstream from the nozzle array, said deflectable guide and said support means defining an upstream extent and a downstream extent, respectively of an area beneath the nozzle array where there is no support structure for a sheet of paper.

5. The ink jet printer of claim 4 which further comprises an ink trough extending across said paper path in said second direction and disposed beneath said open area under the nozzle array for receiving ink droplets ejected by the nozzle array that are not received on a sheet of paper.

* * * * *